United States Patent [19]

Akiho

[11] Patent Number: 4,805,788

[45] Date of Patent: Feb. 21, 1989

[54] CONTAINER HAVING COLLAPSE PANELS WITH LONGITUDINALLY EXTENDING RIBS

[75] Inventor: Ota Akiho, Funabashi, Japan

[73] Assignee: Yoshino Kogyosho Co., Ltd., Tokyo, Japan

[21] Appl. No.: 124,359

[22] Filed: Nov. 19, 1987

Related U.S. Application Data

[63] Continuation of Ser. No. 760,533, Jul. 30, 1985, abandoned.

[51] Int. Cl.[4] ..... B65D 23/00

[52] U.S. Cl. ..... 215/1 C; D9/351; D9/398; D9/410; D9/412; 220/72

[58] Field of Search ..... 215/1 C, 10, 1 R; 220/71, 72; D 9/378–413, 367, 372, 349–355

[56] References Cited

U.S. PATENT DOCUMENTS

| | | | |
|---|---|---|---|
| D. 4,170 | 6/1870 | Rose | D9/402 X |
| D. 171,647 | 3/1954 | Hills . | |
| D. 209,928 | 1/1968 | Linn, Jr. | D9/378 |
| D. 212,669 | 11/1968 | Weckman | D9/378 |
| D. 229,541 | 12/1973 | Anderson | D9/378 |
| D. 244,427 | 5/1977 | Schreser et al. | D9/391 |
| D. 261,864 | 11/1981 | Abramo . | |
| D. 294,117 | 2/1988 | Rogler et al. | D9/390 |
| D. 294,462 | 3/1988 | Ota | D9/392 |
| 3,225,950 | 12/1965 | Josephsen et al. | 215/1 C |
| 3,323,668 | 6/1967 | Hills | 215/10 |
| 3,325,031 | 6/1967 | Singler | 215/1 C |
| 3,397,724 | 8/1968 | Bolen et al. . | |
| 3,499,567 | 3/1970 | Spotts | 215/31 |
| 3,536,223 | 10/1970 | Muhlhoff et al. | 215/1 C |
| 3,708,082 | 1/1973 | Platte . | |
| 3,926,341 | 12/1975 | Lhoest | 215/100 A |
| 3,931,074 | 1/1976 | Gomez | 215/1 C |
| 3,951,296 | 4/1976 | Swanson et al. | 220/72 |
| 4,298,045 | 11/1981 | Weiler . | |
| 4,318,882 | 3/1982 | Agrawal et al. . | |
| 4,372,455 | 2/1983 | Cochran | 220/72 |
| 4,379,099 | 4/1983 | Ota et al. . | |
| 4,387,816 | 6/1983 | Weckman | 215/1 C |
| 4,497,855 | 2/1985 | Agrawal et al. | 215/1 C |

FOREIGN PATENT DOCUMENTS

| | | | |
|---|---|---|---|
| 293908 | 10/1971 | Fed. Rep. of Germany . | |
| 90987 | 3/1968 | France | 215/1 C |
| 54-30654 | 2/1979 | Japan . | |
| 57-126310 | 8/1982 | Japan . | |
| D-606383-4 | 11/1983 | Japan . | |

OTHER PUBLICATIONS

"Gatorade Tests Bottle of Future", *Packaging*, Oct. 1987.

*Primary Examiner*—Stephen Marcus
*Assistant Examiner*—Bryon Gehman
*Attorney, Agent, or Firm*—Parkhurst, Oliff & Berridge

[57] ABSTRACT

A hollow blow-molded container of a biaxially oriented thermoplastic material in which the container walls contain collapse panels with ribs to accommodate evacuation of the container without deleterious changes in the appearance of the container. The ribs within the collapse panels provide for increased rigidity of the container during contraction of the contents of the container, and extend longitudinally along the sides of the collapse panels.

16 Claims, 3 Drawing Sheets

CONTAINER HAVING COLLAPSE PANELS WITH LONGITUDINALLY EXTENDING RIBS

This is a continuation of application Ser. No. 760,533 filed July 30, 1985, now abandoned.

BACKGROUND OF THE INVENTION

The present invention relates to hollow blow-molded containers of a biaxially oriented thermoplastic material, and more particularly to thin-walled plastic containers configured to accommodate partial evacuation without adverse effects on their apperance.

Lightweight, thin-walled containers made of thermoplastic materials such as polyester resin and thermoplastic polymers containing at least 50% by weight polymerized nitrile-groups-containing monomer (hereinafter "nitriles") are well known in the container industry. For example, polyethylene terephthalate (PET) has a wide range of applications in the field of containers for foodstuffs, flavoring materials, cosmetics beverages and so on. PET can be molded, by orientation-blowing, into transparent thin-walled containers having a high stiffness, impact strength and improved hygienic qualities with a high molding accuracy. Strong, transparent and substantially heat resistant containers may be produced by the biaxial-orientation blow-molding process in which a parison is oriented both laterally and longitudinally in a temperature range suitable for such orientation. Nitrile and heat-set PET containers are particularly heat resistant. Biaxially-oriented blow-molded containers have greater stiffness and strength as well as improved gas barrier properties and transparency.

When a thermoplastic container is filled with a hot liquid (such as a liqud sterilized at a high temperature) and sealed, subsequent thermal contraction of the liquid upon cooling results in partial evacuation of the container which tends to deform the container walls. Backflow into a filling mechanism and the use of vacuum filling equipment during filling operations can similarly creat a partial vacuum inside the container resulting in its deformation. Such deformation typically concentrates at the mechanically weaker portions of the container, resulting in an irregular and commercially unacceptable appearance. Further, if the deformation occurs in an area where the label is attached to the container, the appearance of the label may be adversely affected as a result of container deformation.

By increasing the wall thickness of the container it is possible to some extent to strengthen the container walls and thus decrease the effects of vacuum deformation. However, increasing the wall thickness results in a substantial increase in the amount of raw materials required to produce the container and a substantial decrease in production speed. The resultant increased costs are not acceptable to the container industry. Additionally, increase in wall thickness results in decrease in bottle fill capacity.

A prior attempt to reduce the effects of vacuum deformation is disclosed in U.S. Pat. No. 3,708,082 to Platte. Platte discloses a container with four flat wall-panels comprising the body portion of the container. A rib circumscribes the entire container in a region below the handle and serves to rigidify the side wall-portions in a circumferential direction. The rib also acts as a hinge to allow limited inward collapsing of the container along selected regions.

Another prior approach to reduction of the effects of vacuum deformation is disclosed in Japanese Patent Application No. 54-30654. In this approach, a container is provided with a plurality of recessed collapse panels, separated by lands, which allow uniform controlled inward deformation so that vacuum effects are accommodated in a uniform manner without adverse effects on the appearance of the container.

U.S. Pat. No. 4,298,045 to Weiler et al. shows another prior art approach in which a container has rigidifying grooves and embossments provided in the side walls of the container. Rather than controlling collapse, these rigidifying features substantially eliminate collapse, and are thus useful only with relatively low levels of evacuation.

Prior art approaches have included the use of collapse panels (i.e., indented surface areas which provide for controlled, quantified collapse) to overcome thermal deformation; however, problems have developed in containers designed with collapse panels. While collapse panels accommodate a great degree of controlled deformation, as the vacuum inside the containers increases, more and more collapse is required from the collapse panels without permitting collapse of the intervening lands. By increasing the length of the corner step of the collapse panels the rigidity of the lands may be increased. See FIGS. 2 and 3. However, the resultant deeper collapse panel occupies a larger internal volume of the container, and the overflow capacity of the container is significantly decreased. In order to compensate for this decrease in overflow capacity, the container diameter must be increased. Any increase in container diameter, however, decreases container rigidity. Thus, any container rigidity gained by increase in the size of the collapse panel is offset by the need to regain the lost overflow capacity. The present invention eliminates the aforementioned disadvantages.

SUMMARY OF THE INVENTION

The present invention relates to a hollow blow-molded container of biaxially-oriented thermoplastic material, wherein the container walls contain collapse panels, and the collapse panels contain ribs to accommodate a high degree of evacuation of the container without deleterious changes in the container's rigidity or appearance. More specifically, a thin-walled plastic container of the present invention comprises a bottom section, a neck section, and a body section extending between the neck section and the bottom section, the body section including a plurality of collapse panels with longitudinally extending ribs disposed at the sides of the collapse panels.

The ribs extending within the sides of the collapse panels and terminating at the tops and bottoms thereof increase the rigidity of the container without decreasing container overflow capacity or the extent of collapse of the collapse panels, thereby accommodating even very large evacuation effects by controlled, uniform vacuum deformation. Thus the invention is particularly adapted to use with hot-fillable container materials, i.e., materials which safely permit filling of the container with contents at temperatures of 65°–100° C., or more generally 75°–95° C.

DETAILED DESCRIPTION OF PREFERRED EMBODIMENTS OF THE INVENTION

Figure 1:
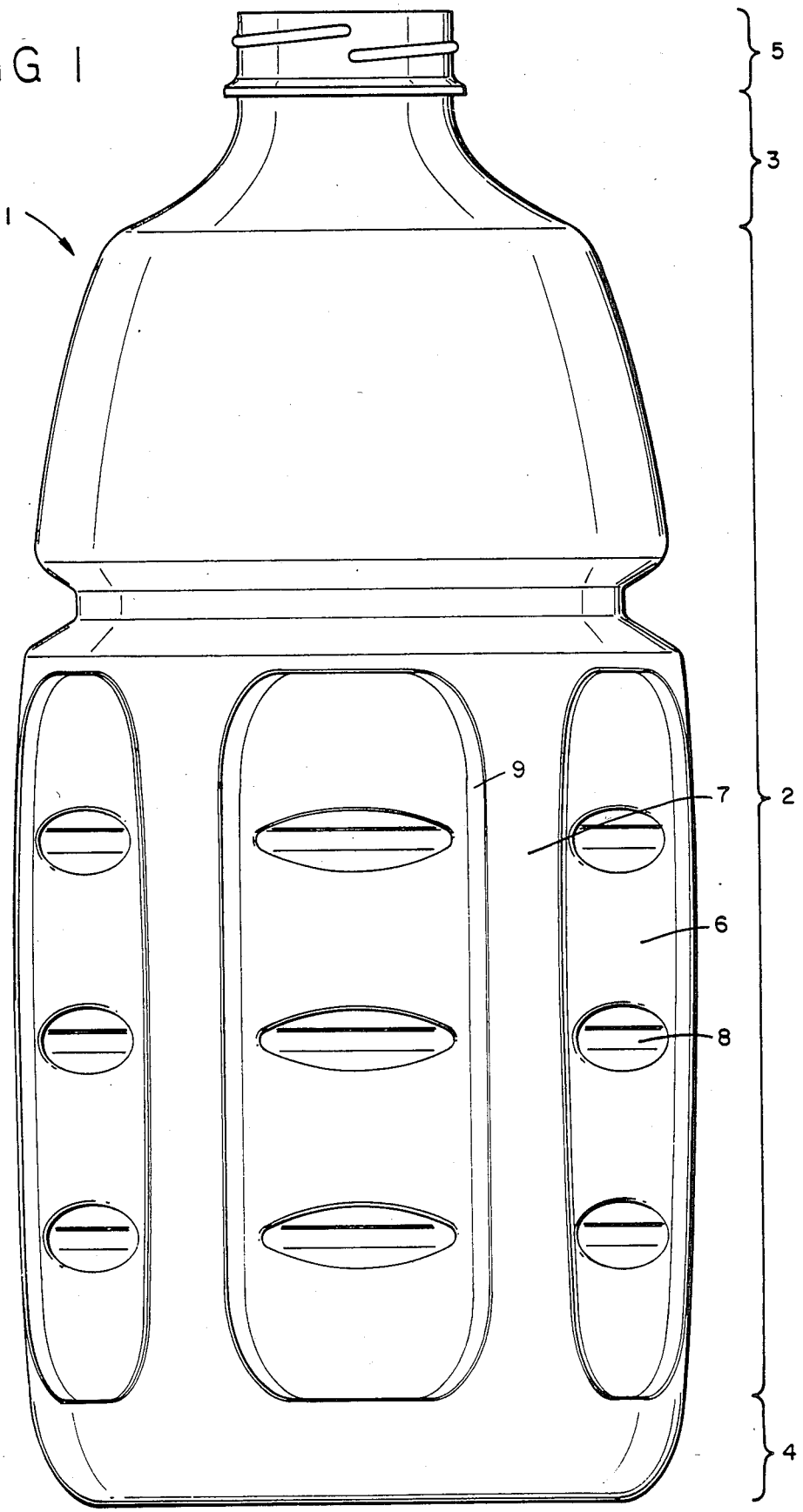
FIG. 1 is a side view of a container of the present invention.
Figure 2:
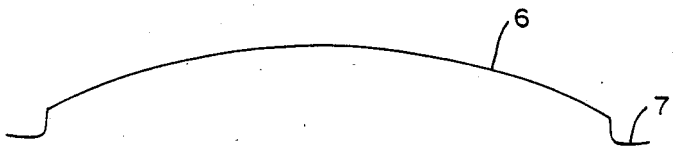
FIG. 2 PRIOR ART
FIG. 2 is a cross-sectional view of a portion of a prior art container.
Figure 3:
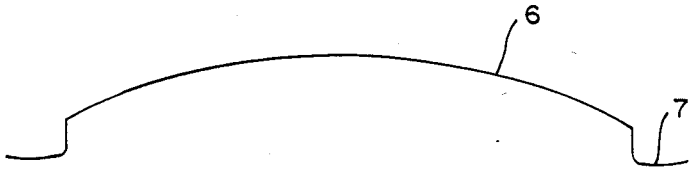
FIG. 3 is a cross-sectional view of a modified portion of the container of FIG. 2.
Figure 4:
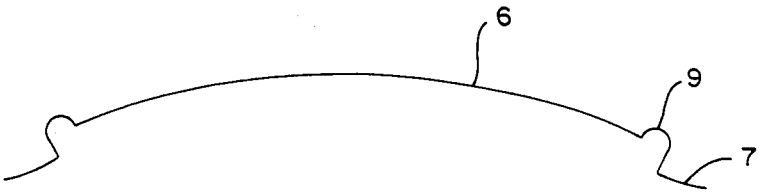
FIG. 4 is a cross-sectional view of a portion of a container of the present invention.

Referring now to the drawings, FIG. 1 depicts a thin-walled blow-molded plastic container 1 which may be formed of polyethylene terephthalate (PET) or a nitrile. The container 1 comprises a body section 2 having a shoulder portion 3. The body section can be of any cross-sectional shape, for example, polygonal such as rectangular, square, hexagonal or octagonal, or round. The lower end of the body section 2 is closed off by bottom section 4. The body section 2 extends upwardly from the bottom section 4 and tapers radially inwardly at the top of the body section to form the shoulder section 3 which terminates at a neck section 5. The neck section 5 may include external threads for a closure (not shown) and the neck section 5 may be crystallized to provide thermal, chemical and mechanical strength in the unstretched neck section as disclosed, for instance, in U.S. Pat. No. 4,379,099.

The body portion 2 of the container is specifically configured to accommodate controlled changes of the volume of the container upon its partial evacuation. As shown in FIG. 1, longitudinally elongated indented collapse panels 6 are formed around the body section 2. A generally rectangular or oval shaped collapse panel 6 may be formed at at least one side, preferably each side, of the polygonal body section 2, and adjacent collapse panels 6 are separated from each other by lands 7. One or more of the collapse panels contain at least one longitudinally extending rib 9 extending along and terminating at the ends of each side thereof.

The longitudinally extending ribs 9 provide rigidity to the lands 7. The depth of the ribs 9 may be selected by one of ordinary skill in the art based on the type of material of the container, the planned contents of the container and the planned filling temperature. Generally, the longitudinally extending ribs 9 have a depth corresponding to the depth of the stepped side of a collapse panel without such ribs 9 which would be required to achieve the same degree of collapse. The cross-sectional shapes of the ribs may readily be selected by one of ordinary skill, again in light of the above factors, but substantially "U"-shaped or "V"-shaped ribs 9 are preferred. The ribs 9 preferably extend over substantially the entire longitudinal length of the associated collapse panel 6, but may be shorter than said length. The ribs 9 extend only longitudinally, and not transversely. Furthermore, the ribs 9 may be discontinous, comprising a number of longitudinally extending rib portions separated by ribless portions of the collapse panel.

Figure 5:
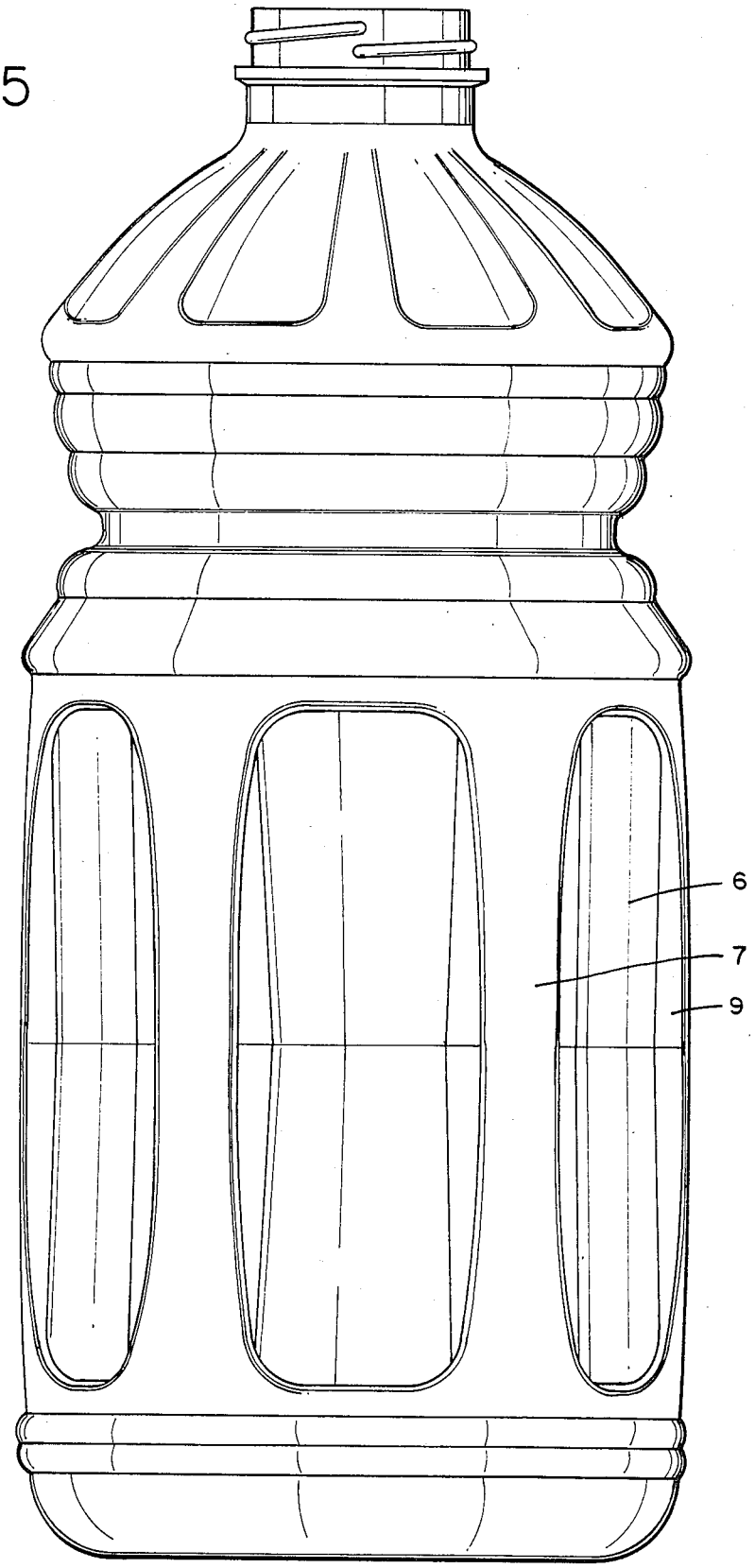
FIG. 5 is a side view of an alternative embodiment of a container of the present invention.

The collapse panels may slope longitudinally to a central transverse crease as shown in FIG. 5 to provide additional collapse panel support. Alternatively, the collapse panels may contain one or more transverse ribs 8 which serve to strengthen the collapse panels 6 against deformation during fabrication and under evacuation. See FIG. 1. The ribs 8 extend solely within the collapse panels and do not extend even to the sides of the collapse panels. The number of ribs 8 per panel depends primarily on the height of the collapse panel, as well as the type and thickness of material forming the container. That is, different materials exhibit different degrees of resistance to deformation under vacuum and in fabrication and the requisite number of ribs 8 per collapse panel will change accordingly. Additionally, the conditions under which the container is filled and the nature of the contents to be filled into the container will affect the number of ribs required. The determination of the number of ribs per panel based on the type of material of the container, the contents of the container and the temperature of filling can be determined by those of ordinary skill in the art upon routine experimentation.

The following examples will illustrate the invention, but are not intended to limit the scope of the patent as defined in the claims appended hereto.

EXAMPLES

In one experiment, four bottles of 64 oz. nominal capacity were formed under similar process conditions. The only variation was in the design of the collapse panels. Two bottles were formed with deep collapse panels without longitudinal ribs, while the other two bottles had shallower collapse panels with a longitudinal rib at each side thereof. The depth of the ribs was the same as the depth of the stepped side of the ribless panels.

Upon vacuum testing, it was found that the bottles with longitudinal ribs were no less rigid than the bottles with the deeper collapse panels. However, the bottles with deeper panels had respective overflow capacities of 1938.4 cc (64.5 oz.) and 1950.1 cc (64.9 oz.), while the bottles with longitudinal ribs had respective overflow capacities of 1987.2 cc (66.1 oz.) and 1992.4 cc (66.3 oz.). Thus the ribbed bottles had an overflow capacity 37.1–54 cc (1.2–1.8 oz.) greater than the other bottles with no decrease in rigidity.

In another experiment, nominally 64 oz. bottles were prepared under similar process conditions, with the only variation again appearing in the design of the collapse panels. Three of the bottles (sample nos. 1–3) had collapse panels without longitudinal ribs, while the other three bottles (sample nos. 4–6) had similar collapse panels with a longitudinal rib at each side thereof. These bottles were then tested to determine the degree of vacuum (in mm Hg) and extent of collapse (in cc) which each bottle would withstand without buckling. The following results were found:

| Sample No. | mm Hg | cc |
|---|---|---|
| 1 | 125 | 140 |
| 2 | 120 | 140 |
| 3 | 120 | 140 |
| Average 1–3 | 122 | 140 |
| 4 | 160 | 200 |
| 5 | 165 | 200 |
| 6 | 135 | 165 |
| Average 4–6 | 153 | 188 |

Thus on average, the bottles with longitudinal ribs could withstand $$25.4\% \left( \frac{153 - 122}{122} \times 100\% \right)$$

more vacuum and $$34.3\% \left( \frac{188 - 140}{140} \times 100\% \right)$$

more collapse without buckling.

Various modifications and alterations of the present invention will be readily apparent to persons skilled in the art. It is intended, therefore, that the foregoing be considered as exemplary and that the scope of the invention be limited only by the following claims.

What is claimed is:

1. A thin-walled container made of thermoplastic material, comprising:

a bottom section;

a neck section; and a body section having a longitudinal axis and extending between said neck section and said bottom section;

said body section including a plurality of collapse panels which provide controlled, quantified collapse upon exposure of an interior of said container to a partial vacuum; lands between adjacent said collapse panels; and at least one longitudinal support rib extending longitudinally along each side of at least one of said plurality of collapse panels between said at least one of said collapse panels and an adjacent said land and being shorter than a length of said at least one of said plurality of collapse panels, each said longitudinal rib being indented with respect to its adjacent respective collapse panel side at all points along its length in the longitudinal axis.

2. The container of claim 1, wherein one said longitudinal rib extends longitudinally along each side of each of said plurality of collapse panels.

3. The container of claim 2, wherein each said longitudinal rib extends along substantially an entire longitudinal length of each of said plurality of collapse panels.

4. The container of claim 1, wherein said material is a hot-fillable container material.

5. The container of claim 4, wherein said material is heat set polyethylene terephthalate.

6. The container of claim 5, wherein said neck section is crystallized.

7. The container of claim 4, wherein said material is a nitrile.

8. The container of claim 1, wherein said at least one of said plurality of collapse panels slopes longitudinally inwardly to a transverse crease across a longitudinally central portion of said panel.

9. The container of claim 1, wherein at least one transverse reinforcing rib extends within at least one of said plurality of collapse panels.

10. The container of claim 1, wherein each said longitudinal rib extends along substantially an entire longitudinal length of said at least one of said plurality of collapse panels.

11. The container of claim 1, wherein said collapse panels are transversely concave.

12. The container of claim 1, wherein each said longitudinal rib reinforces a side of one of said lands.

13. A thin-walled container made of thermoplastic material, said material being a hot-fillable container material and said container comprising a bottom section, a neck section, and a body section having a longitudinal axis and extending between said bottom section and said neck section; said body section including at least one longitudinally elongated collapse panel which provides controlled, quantified collapse upon exposure of an interior of said container to a partial vacuum; at least one land outside said collapse panel between adjacent collapse panel sides; a support rib extending longitudinally along each side of said collapse panel between said collapse panel and an adjacent said land and terminating near upper and lower ends of said collapse panel, each said longitudinal rib being indented with respect to its adjacent respective collapse panel side at all points along its length in the longitudinal axis.

14. The container of claim 13, wherein at least one transverse reinforcing rib extends within said at least one collapse panel.

15. The container of claim 13, wherein said at least one collapse panel slopes longitudinally inwardly to a transverse crease across a longitudinally central portion of said panel.

16. The container of claim 13, wherein said collapse panel is transversely concave.

* * * * *

UNITED STATES PATENT AND TRADEMARK OFFICE

CERTIFICATE OF CORRECTION

PATENT NO. : 4,805,788

DATED : February 21, 1989

INVENTOR(S) : Akiho OTA

It is certified that error appears in the above-identified patent and that said Letters Patent is hereby corrected as shown below:

On the title page:

Under item [19], change "Akiho" to --Ota--;

Item [75], change "Ota Akiho" to --Akiho Ota--.

Signed and Sealed this

Sixteenth Day of October, 1990

*Attest:*

HARRY F. MANBECK, JR.

*Attesting Officer*

*Commissioner of Patents and Trademarks*